United States Patent [19]

Shimada

[11] Patent Number: 4,714,039

[45] Date of Patent: Dec. 22, 1987

[54] SEWING MACHINE DRIVING SYSTEM

[75] Inventor: Masami Shimada, Nagoya, Japan

[73] Assignee: Brother Kogyo Kabushiki Kaisha, Nagoya, Japan

[21] Appl. No.: 919,177

[22] Filed: Oct. 15, 1986

[30] Foreign Application Priority Data

Oct. 17, 1985 [JP] Japan ..... 60-231687

[51] Int. Cl.[4] ..... D05B 69/22

[52] U.S. Cl. ..... 112/275

[58] Field of Search ..... 112/275, 277, 220, 121.11, 112/67, 87; 318/369

[56] References Cited

U.S. PATENT DOCUMENTS

| | | | |
|---|---|---|---|
| 3,910,211 | 10/1975 | Kubokura | 112/275 |
| 4,080,914 | 3/1978 | Ishida et al. | 112/277 |
| 4,137,860 | 2/1979 | Yoneji et al. | 112/277 |
| 4,545,314 | 10/1985 | Fujikawa | 112/275 |
| 4,627,370 | 12/1986 | Nakamura | 112/275 |

FOREIGN PATENT DOCUMENTS

| | | |
|---|---|---|
| 1375540 | 11/1974 | United Kingdom . |
| 1461174 | 1/1977 | United Kingdom . |
| 2021163 | 11/1979 | United Kingdom . |
| 2114614 | 8/1983 | United Kingdom . |

*Primary Examiner*—Peter Nerbun

*Attorney, Agent, or Firm*—Jordan and Hamburg

[57] ABSTRACT

A sewing machine driving system comprises: a reluctance motor operatively coupled to a sewing machine main shaft and having a stator and a rotor; a drive circuit for driving the reluctance motor; an angular position detector for detecting the angular position of the rotor with respect to the stator; a needle position detector for detecting the position of a sewing needle connected to the main shaft; a first control unit responsive to a drive command and a signal from the angular position detector for driving the reluctance motor at variable speeds; and a second control unit responsive to a stop command and signals from the angular position detector and the needle position detector for braking the reluctance motor to stop the sewing needle in a prescribed needle position.

18 Claims, 10 Drawing Figures

SEWING MACHINE DRIVING SYSTEM

BACKGROUND OF THE INVENTION

1. Field of the invention

The present invention relates to a sewing machine driving system, and more particularly to a sewing machine driving system including a controller for operating a sewing machine at a desired speed to sew a fabric piece and thereafter stopping a sewing needle at a prescribed position.

2. Description of the Prior Art

Various control systems for sewing machine drivers having a needle position stopping capability are known in the art. For example, U.S. Pat. No. 3,910,211 discloses a control system employing an electromagnetic clutch and brake system. The control system shown in U.S. Pat. No. 4,080,914 comprises an eddy-current braking system. According to U.S. Pat. No. 4,137,860, a DC motor control system is disclosed for a sewing machine.

The electromagnetic clutch and brake system includes a clutch motor having a coupling which comprises a combination of an electromagnetic clutch and an electro-magnetic brake for changing the speeds of rotation of the motor and stopping the motor.

As shown in FIG. 8 of the accompanying drawings, the disclosed coupling includes a flywheel 2 fixed to the output shaft 1 of an induction motor, the flywheel 2 being rotated at all times while the the motor is being energized. When there is no load on the motor, the flywheel 2 stores rotational energy. A friction disc 3 is mounted on an outer side of the flywheel 2, and another friction disc 5 is mounted on a bracket 4 which is positioned in confronting relation to the flywheel 2. Between the friction discs 3, 5, there are disposed a movable clutch disc 8 and a movable brake disc 9 which are axially slidable on a spline sleeve 7 forced-fitted over an output shaft 6. Linings 10, 11 are fixed respectively to the outer sides of the clutch and brake discs 8, 9 which face the friction discs 3, 5, respectively. The discs 8, 9 have outer peripheral surfaces providing a portion of a magnetic path formed by electromagnets 14, 15 that are energized by respective coils 12, 13.

The coupling thus constructed operates as follows: When the electromagnet 14 is energized, a magnetic flux flows through the friction disc 3 and the outer peripheral edge of the movable clutch disc 8 to magnetically attract the movable disc 8 toward the flywheel 2. As the disc 8 is thus moved axially, the lining 10 is pressed against the friction disc 3 as it rotates, whereupon the torque of the flywheel 2 is transmitted through the spline sleeve 7 to the output shaft 6.

Upon enegization of the electromagnet 15 under this condition, a magnetic flux flows through the outer peripheral edge of the movable brake disc 9 and the friction disc 5 to magnetically attract the disc 9 toward the bracket 4. This axial movement of the disc 9 presses the lining 11 against the friction disc 5 to couple the output shaft 6 to the bracket 4, thus braking the output shaft 6.

The currents flowing through the coils 12, 13 may be controlled to provide a partly connected clutch condition.

The output shaft 6 is operatively connected by a belt and pulleys to a sewing machine drive shaft. The motor is controlled in speed by a signal fed back from a speed sensor mounted on the sewing machine drive shaft.

Sewing machines for industrial use with a needle position stopping capability and a thread cutting capability are required to provide an intermediate operation speed. To obtain such an intermediate operation speed, the coupling is controlled at the partly connected clutch condition, in which the linings 10, 11 are worn of necessity. If wrong materials were selected for the linings 10, 11, the linings 10, 11 would be responsible for troubles.

The disclosed coupling requires constant maintenance since the worn linings 10, 11 must be replaced. However, the servicing of the linings 10, 11 is problematic because they're not worn uniformly.

The eddy-current braking system employs an eddy-current coupling in place of the coupling of the electromagnetic clutch and brake system. The eddy-current coupling is better than the electromagnetic clutch and brake system in that there is no lining wear problem inasmuch as the torque output is transmitted without any physical contact.

The eddy-current coupling mechanism is shown in FIG. 9 of the accompanying drawings. An induction motor has a motor shaft 20 with a rotating member 21 mounted thereon. The rotating member 21 comprises a driver 21*a* made of a nonmagnetic material, a claw pole 21*b* connected to the driver 21*a*, a nonmagnetic member 21*c* mounted on a distal end of the claw pole 21*b*, and a yoke 21*d* joined to the nonmagnetic member 21*c*.

A cup-shaped cylindrical member 24 of copper is mounted by a hub 23 on an output shaft 22 and extends into a gap defined between the claw pole 21*b* and the yoke 21*d*. The induction motor also has an intermediate bracket 25 to which an excitation coil 27 is attached by a ring-shaped steel plate 26. When the excitation coil 27 is energized, a magnetic flux is generated as indicated by the broken lines.

When the magnetic flux is generated by energization of the excitation coil 27, it flows from the claw pole 21*b* through the cylindrical member 24 as the rotating member 21 rotates. This magnetic flux is equivalent to a rotating magnetic field applied to the cylindrical member 24, causing an eddy current to be produced in the cylindrical member 24.

The eddy current and the claw pole 21*b* coact to produce an attractive force between the cylindrical member 24 and the claw pole 21*b* for transmitting the motor torque from the motor shaft 20 to the output shaft 22 without any physical contact. Since the transmitted torque varies by changing the magnitude of the exciting current flowing through the excitation coil 27, the speed of rotation of a load coupled to the output shaft 22 can be controlled in a stepless manner by changing the magnitude of the exciting current.

Problems with the eddy-current braking system are that since the cylindrical member 24 is of a coreless structure for desired response, the thermal capacity thereof is limited and the permeance thereof is low thus limiting the magnitude of the magnetic flux. As a result, the transmitted torque is low.

With the eddy-current braking system as well as the electromagnetic clutch and brake system, the motor has to be rotated at all times, and hence the power consumption of the motor while the coupling is not in operation and the noise of the motor while it is idly rotating are disadvantageous.

The DC motor control system employs a DC servomotor. The DC motor control system eliminates the problems of the electromagnetic clutch and brake system and the eddy-current braking system, and can perform ideal sewing machine control because of its high response. The motor is normally de-energized since it is started by depressing a sewing machine pedal. Accordingly, a large amount of electric power can be saved and there is no noise problem.

However, the DC motor suffers from the problem of brush wear. Where the sewing machine is used very often and transformerless AC-to-DC conversion is effected in a high-voltage region (such as in Europe), some measure must be taken to reduce brush wear. When the brush service life is terminated, the brush must be replaced and brush powder must be removed. Therefore, the motor requires maintenance relatively frequently.

The applicant has found that all of the above conventional drawbacks can be removed by designing a DC motor control system with a brushless motor, and directed attention to an AC servomotor system taking advantage of semiconductor control technology which has been advanced rapidly in recent years. The applicant has considered a system in which a synchronous motor with a permanent magnet field is used and a system in which an induction motor is used. These motors require a power converter composed of a converter and an inverter. It has been found that since the motors can be driven at variable speeds primarily by controlling the inverter, the same speed control as that of the DC motor can be achieved even though the motors are brushless.

Although the synchronous motor with a permanent magnet field only needs a relatively simple control circuit, the permanent magnet is disposed on a rotor side and there is a certain problem as to how the permanent magnet is fixed. In addition, the permanent magnet tends to be demagnetized by an overcurrent and a peak current of the stator. The synchronous motor with a permanent magnet field is expensive to construct because a high-resolution encoder or a costly resolver must be used in order to accurately detect pole positions.

The induction motor is rugged and inexpensive inasmuch as the rotor comprises an aluminum die casting rotor. However, a loss on the stator is large because the stator is relied upon for the supply of electromagnetic energy, and the temperature rise due to a copper loss on the rotor which arises from the generation of a secondary current is higher than that of the synchronous motor. The controller for the induction motor is rendered complex and expensive by the use of a transvector system and means for compensating for a change in the secondary resistance.

SUMMARY OF THE INVENTION

It is an object of the present invention to provide a sewing machine driving system which can effect sewing machine control with good response, is durable, has a reduced extent of factors responsible for manufacturing variations or errors, and is maintenance-free.

According to an aspect of the present invention, there is provided a sewing machine driving system comprising: a reluctance motor operatively coupled to a sewing machine main shaft and having a stator and a rotor; a drive circuit for driving said reluctance motor; an angular position detector for detecting the angular position of said rotor with respect to said stator; a needle position detector for detecting the position of a sewing needle connected to said main shaft; a first control unit responsive to a drive command and a signal from said angular position detector for driving said reluctance motor at variable speeds; and a second control unit responsive to a stop command and signals from said angular position detector and said needle position detector for braking said reluctance motor to stop said sewing needle in a prescribed needle position.

According to another aspect of the present invention, there is provided a sewing machine driving system comprising: a reluctance motor operatively coupled to a sewing machine main shaft and having a stator and a rotor; a drive circuit for driving said reluctance motor; an angular position detector for detecting the angular position of said rotor with respect to said stator; a speed detector for detecting the actual speed of rotation of said reluctance motor; a needle position detector for detecting the position of a sewing needle connected to said main shaft; a control pedal; a speed command signal generator for commanding a speed of rotation of said reluctance motor based on the extent to which said control pedal is operated; a first control unit for comparing the speed of rotation detected by said speed command signal generator based on operation of said control pedal and the actual speed of rotation of said reluctance motor detected by said speed detector, and for driving said reluctance motor at variable speeds in response to a signal from said angular position detector in order to achieve the speed of rotation selected by said control pedal; and a second control unit responsive to the stoppage of operation of said control pedal and signals from said angular position detector and said needle position detector for braking said reluctance motor to stop said sewing needle in a predetermined needle position.

According to still another aspect of the present invention, there is provided a sewing machine driving system comprising: a reluctance motor operatively coupled to a sewing machine main shaft and having a stator and a rotor; a drive circuit for driving said reluctance motor; an angular position detector for detecting the angular position of said rotor with respect to said stator; a needle position detector for detecting the position of a sewing needle connected to said main shaft; a control pedal; a first control unit responsive to a forward depression of said control pedal and a signal from said angular position detector for driving said reluctance motor at variable speeds; a second control unit responsive to a neutral position of said control pedal and signals from said angular position detector and said needle position detector for braking said reluctance motor to stop said sewing needle in a predetermined needle stop position; and a third control unit responsive to a rearward depression of said control pedal and signals from said angular position detector and said needle position detector for controlling said reluctance motor to stop said sewing needle in a predetermined needle position and for energizing a solenoid to operate a thread cutting device.

Other and further objects of the invention will become obvious upon an understanding of the illustrative embodiment about to be described or will be indicated in the appended claims, and various advantages not referred to herein will occur to one skilled in the art upon employment of the invention in practice.

BRIEF DESCRIPTION OF THE DRAWINGS

FIG. 5(*b*) is a graph showing the relationship between the spatial phase difference and a torque;

DESCRIPTION OF THE PREFERRED EMBODIMENT

Figure 1:
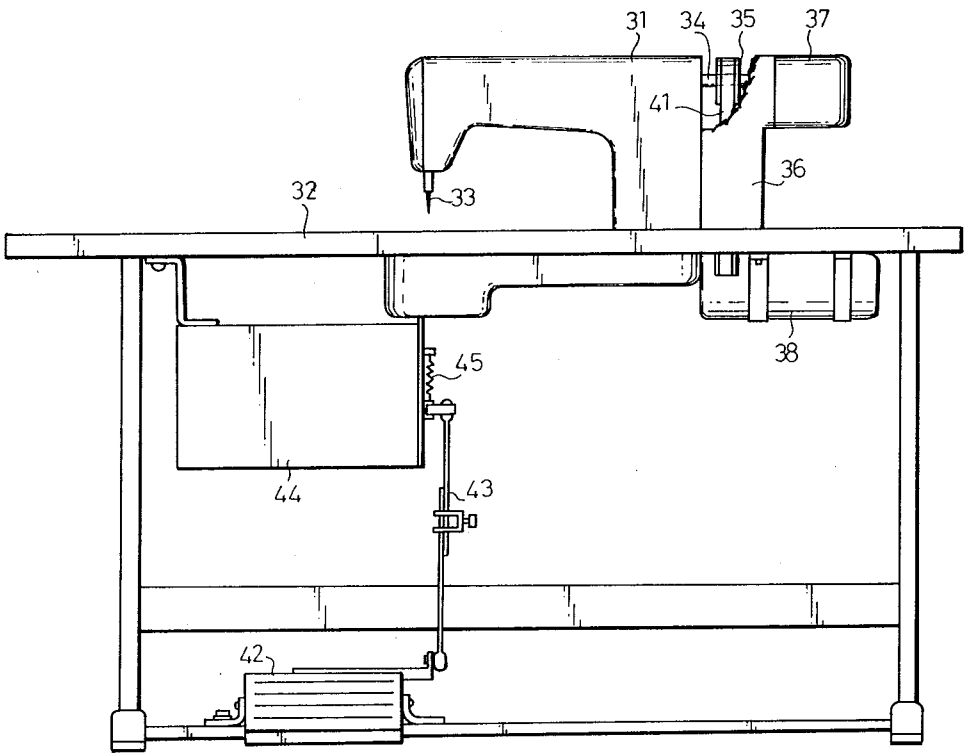
FIG. 1 is a front elevational view of a motor-operated sewing machine incorporating a sewing machine driving system according to the present invention.

As shown in FIG. 1, a sewing machine body 31 is mounted on a sewing machine table 32 and houses a main shaft 34 for vertically moving a sewing needle 33, the main shaft 34 supporting a pulley 35 on one end remote from the sewing needle 33. The main shaft 34 and the pulley 35 are covered with a barcket 36. A sensor 37 for detecting the position of the sewing needle 33 and the speed of rotation of the main shaft 34 is mounted on the bracket 36 near the end of the main shaft 34 on which the pulley 35 is supported. The sensor 37 detects an angular position of the main shaft 34 to produce a signal for providing upper and lower positions of the sewing needle 33 and a signal for providing the speed of rotation of the main shaft 34.

A reluctance motor 38 is mounted on the underside of the table 32 and has an output shaft 39 (FIG. 2) on which a pulley 40 is fixedly mounted. An endless belt 41 is trained around the pulley 40 and the pulley 35 on the main shaft 34.

A control foot pedal 42 is disposed below the table 32 and can be depressed from a neutral position selectively to forward and rearward positions. A connector bar 43 has a lower end coupled to the pedal 42 and an upper end connected to a detector (described later) disposed in a control box 44 for detecting the position and depth to which the pedal 42 has been depressed. The connector bar 43 is normally urged by a spring 45 to keep the pedal in the neutral position.

Figure 2:
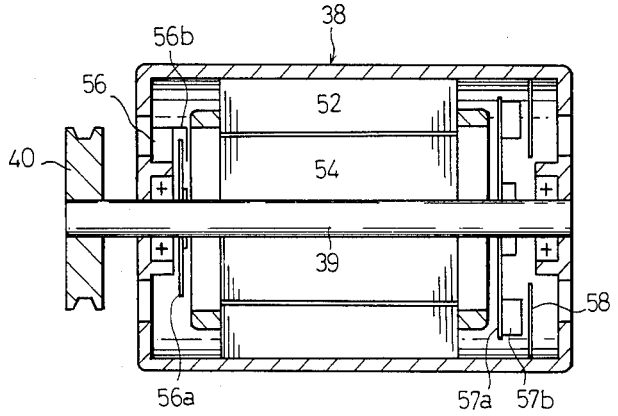
FIG. 2 is an axial cross-sectional view of a reluctance motor.
Figure 3:
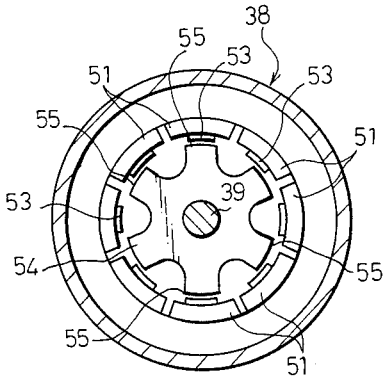
FIG. 3 is a transverse cross-sectional view of the reluctance motor.

The reluctance motor 38 will be described with reference to FIGS. 2 and 3.

The reluctance motor 38 has a stator comprising a laminated iron core 52 supporting thereon concentrated windings 51 and having eight magnetic poles 53 according to the illustrated embodiment. The motor 38 also has a rotor comprising a laminated iron core 54 force-fitted over the output shaft 39 and six salient magnetic poles 55 according to the illustrated embodiment.

The reluctance motor 38 includes in its front portion an angular position detector 56 comprising a rotatable disc **56*a* fixed to the output shaft 39 and a photointerrupter 56*b* for detecting slits formed in the rotatable disc 56*a*. The angular positions of the poles 55 can be derived from a signal generated by the angular position detector 56**.

The reluctance motor 38 also includes in its rear portion a speed detector 58 comprising a rotatable disc **57*a* fixed to the output shaft 39 and a detector (hall element) for detecting magnets 57*b* attached to the rotatable disc 57*a*. The speed of rotation of the motor 38 can be derived from a signal generated by the speed detector 58**.

Figure 4:
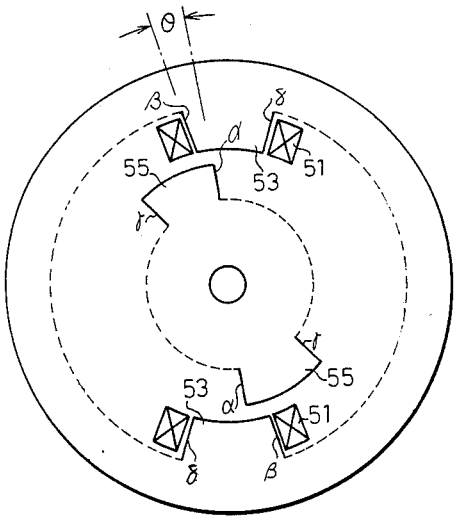
FIG. 4 is a schematic view explaining a spatial phase difference in the reluctance motor.

The torque T produced by the reluctance motor 38 thus constructed can be expressed as a function of a spatial phase difference $\theta$ (FIG. 4) between the stator poles 53 and the rotor poles 55 and a current (instantaneous value) i flowing through the stator windings 51, as follows:

$$T = dW(\theta, i)/d\theta$$

where W ($\theta$, i) is the CO-energy of the magnetic path.

Neglecting the magnetic nonlinearity, the torque T can be simplified as:

$$T = \frac{i^2}{2} \frac{dL(\theta)}{d(\theta)}$$

where L ($\theta$) is the self-inductance of the magnetic path and only related to the spatial phase difference.

Figure 5A:
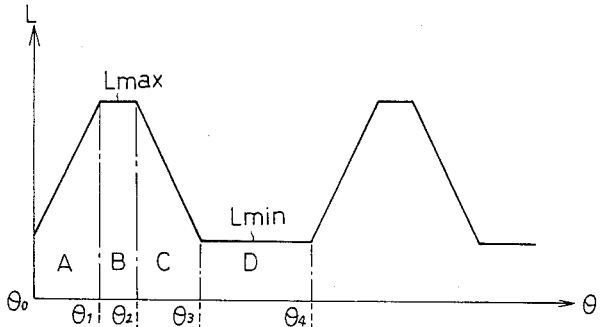
FIG. 5(*a*) is a graph showing the relationship between a spatial phase difference and a self-inductance.
Figure 5B:
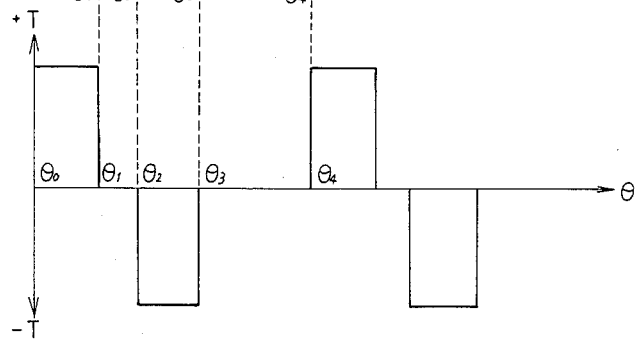

The self-inductance L varies with respect to the spatial phase difference $\theta$ as shown in FIG. 5(*a*). In a region A, terminal ends $\alpha$ of the rotor poles 55 in the clockwise of rotation of the rotor (see FIG. 4) are aligned with ends $\beta$ of the stator poles 53 at $\theta=\theta 0$, and as the rotor rotates, the self-inductance L linearly increases from a minimum level Lmin. The self-inductance L continues to increase up to $\theta=\theta 1$ when the poles 53, 55 are fully overlapped in the radial direction. Terminal ends $\gamma$ of the rotor poles 55 are aligned with ends $\beta$ of the stator poles 53 at $\theta=\theta 1$.

In a region B from $\theta 1$ to $\theta 2$ in which the poles 53, 55 are continuously overlapped in the radial direction, the self-inductance L is maintained at a maximum level Lmax ($dL/d\theta=0$). Terminal ends $\alpha$ of the rotor poles 55 are aligned with ends $\delta$ of the stator poles 53 at $\theta=\theta 2$.

Then, the self-inductance L linearly decreases from the maximum level Lmax to the minimum level Lmin in a region C from $\theta 2$ to $\theta 3$. Terminal ends $\gamma$ of the rotor poles 55 are aligned w1th ends $\delta$ of the stator poles 53 at $\theta=\theta 3$.

In a region D from $\theta 3$ to $\theta 4$, the poles 53, 55 are not radially overlapped, and the self-inductance L is kept at the minimum level Lmin ($dL/d\theta=0$).

The period of one cycle from $\theta 0$ to $\theta 4$ is equal to the pitch of the rotor poles. Where the motor rotates at a constant speed, the frequency of the self-inductance L is proportional to the number of rotor pole pairs.

With the current being constant, the torque T varies with respect to the self-inductance L as illustrated in FIG. 5(*b*). In the region A, the torque T is positive, and in the region C, the torque T is negative. The positive and negative torques are produced without changing the direction of the current.

Therefore, the reluctance motor 38 can be driven by utilizing the positive torque T in the region A within one cycle, and can be braked by utilizing the negative torque T in the region C.

It will thus be understood that the motor 38 can thus be driven by supplying the current only during the region A, and braked by supplying the current only during the region C. In reality, however, the motor may be driven and braked by supplying the current in other regions according to various conditions.

Since the periodic nature shown in FIGS. 5(*a*) and 5(*b*) remains the same, the motor 38 can be driven and braked by appropriately selecting the timing at which the current is supplied to the windings 51 of the stator.

Figure 6:
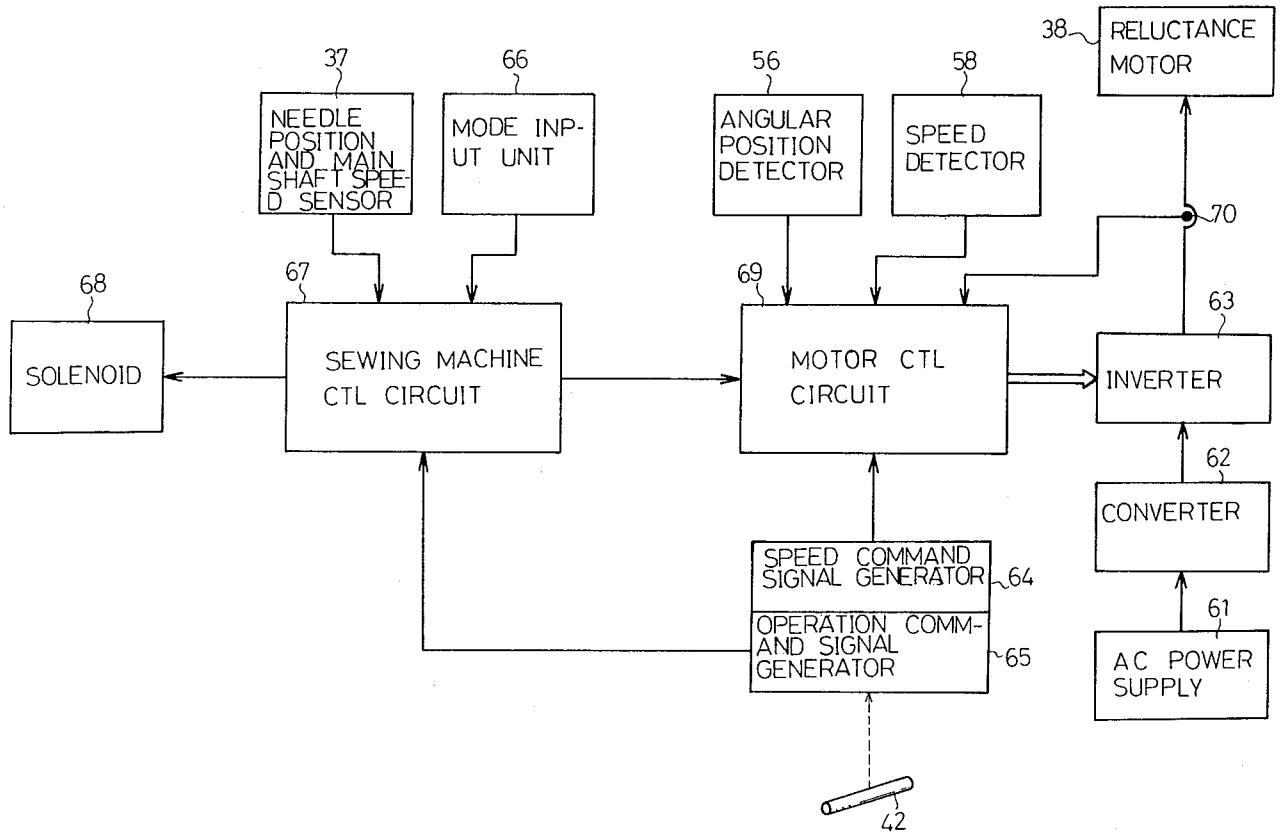
FIG. 6 is a block diagram of the sewing machine driving system.

A control system for controlling operation of the sewing machine will be described with reference to FIG. 6.

An alternating current supplied from an AC power supply 61 is converted by a converter 62 to a direct current which is fed through an inverter 63 to the reluctance motor 38. A speed command signal generator 64 is operatively coupled to the control pedal 42 for detecting the extent of depression of the pedal 42. An operation command signal generator 65 is operatively coupled to the control pedal 42 for detecting the position to which the pedal 42 is depressed. A sewing machine mode input unit 66 is operated by the operator for presetting a desired sewing machine mode of operation.

A sewing machine control circuit 67 is supplied with signals from the needle position and main shaft speed sensor 37, the operation command signal generator 65, and the sewing machine mode input unit 66. In response to these signals, the sewing machine control circuit 67 issues a drive signal to energize a solenoid 68 for actuating a thread cutting device (not shown) and a thread cutting command signal to initiate a thread cutting operation.

A motor control circuit 69 serves to effect switching of the inverter 63 and is supplied with signals from the angular position detector 56, the speed detector 58, and the speed command signal generator 64. The motor control circuit 69 is also supplied with various command signals from the sewing machine control circuit 67 and a feedback signal from an output transducer 70 to detect the magnitude of a load current.

The motor control circuit 69 responds to the supplied input signals to determine an optimum timing at which to energize the windings 51 on the stator poles 53 of the reluctance motor 38 and applies a timing signal to the inverter 63. The inverter 63 is responsive to the applied timing signal for controlling the energization of the windings 51.

Operation of the sewing machine thus constructed will be described below.

When the control foot pedal 42 is depressed to the forward position for sewing a fabric piece on the table 32, the operation command signal generator 65 detects such a pedal depression and applies a pedal position signal to the sewing machine control circuit 67. The speed command signal generator 64 also applies a speed command signal to the motor control circuit 69.

In response to the pedal position signal, the sewing machine control circuit 67 determine the sewing operation. The motor control circuit 69 responds to the speed command signal to determine the angular position of the rotor poles 55, i e., the spatial phase difference of the rotor poles 55 against the stator poles 53, based on a signal from the angular position detector 56 in order to start the reluctance motor 38. The motor control circuit 69 also determines, at each this time, those stator poles 53 which produce the positive torque T when the windings 51 are energized, and those stator poles 53 which produce the negative torque T when the windings 51 are energized.

Then, the motor control circuit 69 applies a timing control signal to the inverter 63 to energize only the windings 51 on those poles 53 which can generate the positive torque T. Therefore, the rotor of the reluctance motor 38 can produce the positive torque T to start rotating the reluctance motor 38.

The speed of rotation of the reluctance motor 38 is determined by the depth to which the control pedal 42 has been depressed. The motor control circuit 69 is responsive to the signal from the speed command signal generator 64 to detect the speed of rotation which is indicated by the operator, and also responsive to the signal from the speed detector 58 to detect the actual speed at the time. The motor control circuit 69 then compares these two speeds and controls the reluctance motor 38 to rotate at the speed that is set by the control pedal 42. The speed control at this time can be performed by controlling the winding energization time in the region A in which the positive torque T is produced. The speed control may be effected by controlling the voltage applied to energize the windings.

It is possible to preset the maximum speed achieved by depression of the control pedal 42 irrespective of how the control pedal 42 is depressed. In this case, the maximum speed can be varied by a separate semi-fixed rheostat.

The reluctance motor 38 is now rotated at the speed dependent on the depth to which the control pedal 42 has been depressed, thereby to operate the sewing machine for sewing the fabric piece.

When the control pedal 42 is returned to the neutral position as the sewing process approaches an end, the sewing machine control circuit 67 responds to the position signal from the operation command signal generator 65 to determine that the sewing machine operation is to be stopped. The sewing machine control circuit 67 then issues a motor braking control signal to quickly lower the speed of rotation of reluctance motor 38 down to a predetermined low speed range and to keep the motor speed in that low speed range for a predetermined period of time.

The motor control circuit 69 is responsive to the motor braking control signal for applying a timing control signal to the inverter 63 to energize the windings 51 on only those stator poles 53 which can produce the negative torque T. Therefore, the negative torque T is produced on the rotor of the reluctance motor 38, which is quickly braked and decelerated.

When the motor control circuit 69 detects that the speed of the reluctance motor 38 reaches the predetermined low speed range in response to the signal from the speed detector 58, the motor control circuit 69 controls the motor 38 so that the speed of the motor 38 is maintained in the predetermined low speed range for the predetermined period of time. At this time, the motor control circuit 69 applies a timing control signal to the inverter 63 in order to generate the positive torque T on the rotor in the same manner as described above and keep the motor speed in the low speed range.

When the sewing machine control circuit 67 detects that the speed of the main shaft 34 reaches a predetermined low speed and the sewing needle 33 is in a lower needle position in response to the signal from the sensor 37, the sewing machine control circuit 67 applies a stop control signal to the motor control circuit 69 to stop the sewing needle 33 in the lower needle position. In response to the stop control signal, the motor control circuit 69 applies a timing control signal to the inverter 63 to brake the reluctance motor 38 to a stop.

Since the reluctance motor 38 rotates at the low speed, it can immediately be stopped. The accuracy with which the operation of the sewing machine is stopped may further be increased by adding a conventional mechanical brake.

Figure 7:
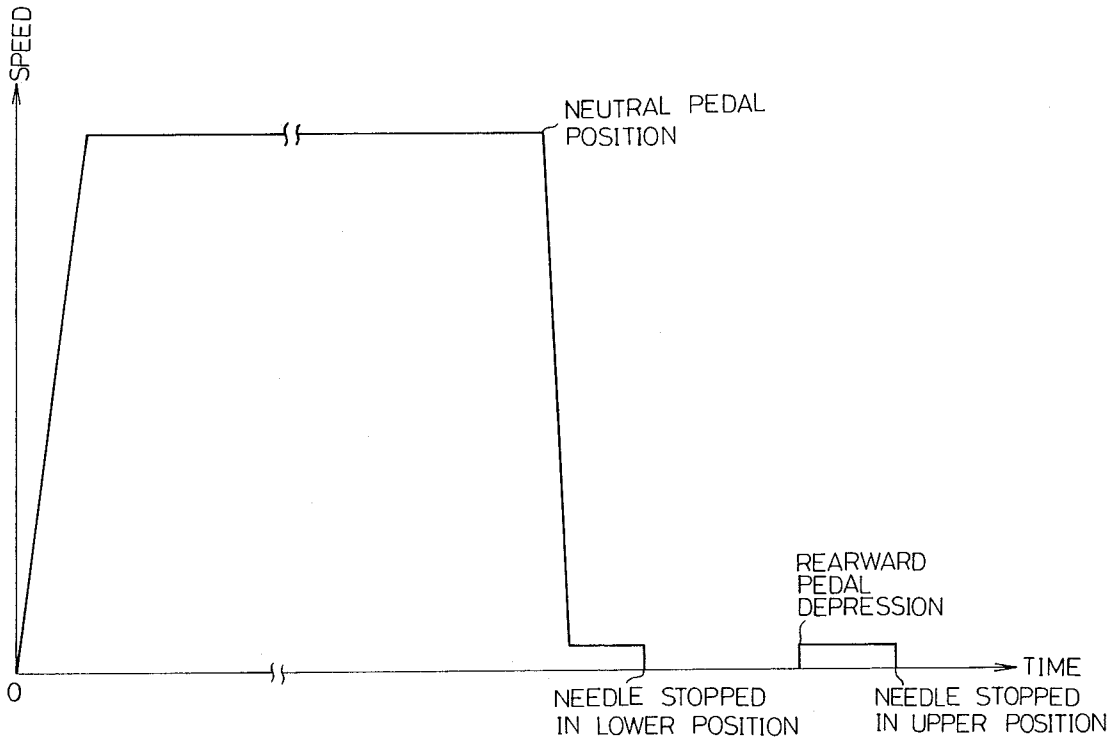
FIG. 7 is a graph showing a motor speed curve during a sewing proces.
Figure 9:
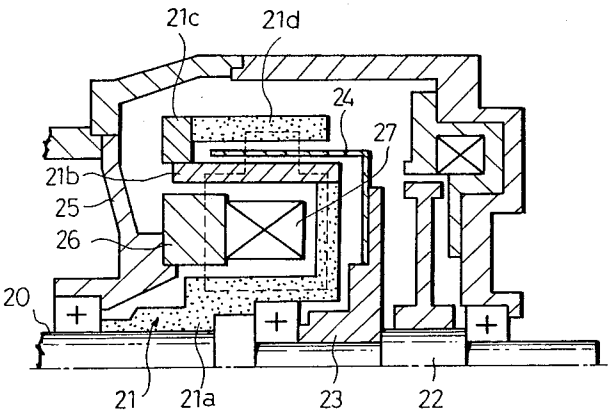
FIG. 9 PRIOR ART
FIG. 9 is a fragmentary cross-sectional view of an eddy-current braking system in a conventional sewing machine driving system.
Figure 8:
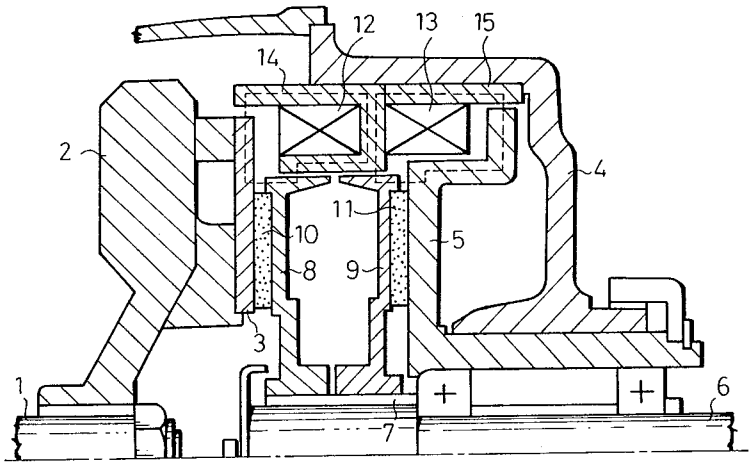
FIG. 8 PRIOR ART
FIG. 8 is a fragmentary cross-sectional view of an electromagnetic clutch and brake system employed in a conventional sewing machine driving system.

When the control pedal 42 is depressed to the rearward position after the sewing machine operation has been stopped, the sewing machine control circuit 67 energizes the solenoid 68 for actuating a thread cutting device in response to the position signal from the operation command signal generator 65. Simultaneously, the sewing machine control circuit 67 applies a control signal to the motor control circuit 69 to rotate the reluctance motor 38 at the low speed (see FIG. 7) in order to raise the sewing needle 33 from the lower needle position to an upper needle position.

When the thread cutting device completes its operation and the sewing needle 33 reaches the upper position, the control circuit 67 applies a stop control signal to the motor control circuit 69 in response to the needle upper position signed from said sensor 37. The motor control circuit 69 applies a timing control signal to the inverter 63 to brake the reluctance motor 38 to stop the same in response to said stop control signal. Therefore the reluctance motor 38 is braked, and the sewing needle 33 moves past the upper needle position and is stopped in a position slightly below the upper needle position. One sewing process for sewing the fabric piece is thus finished.

As described above, the reluctance motor 38 comprises a stator in the form of a laminated iron core 52 having a number of poles 53 with concentrated windings 51 thereon and a rotor in the form of a laminated iron core 54 having a different number of poles 55 from the number of poles 53. The structure of the reluctance motor 38 is therefore simpler and more rugged than induction motors. Since there is no squirrel-cage winding on the rotor, any unstable factors which would otherwise result from such rotor winding are not present. As the stator windings 51 are concentrated windings, the number of manufacturing steps is small and the stator windings 51 are highly reliable in operation.

The sewing machine driving system of the invention can perform sewing machine control with much higher response than conventional sewing machine driving systems, is highly durable, and has a reduced extent of factors which are responsible for manufacturing errors or variations.

As many apparently widely different embodiments of this invention may be made without departing from the spirit and scope thereof, it is to be understood that the invention is not limited to the specific embodiment thereof except as defined in the appended claims.

What is claimed is:

1. A sewing machine driving system comprising:

a reluctance motor operatively coupled to a sewing machine main shaft and having a stator and a rotor;

a drive circuit for driving said reluctance motor;

an angular position detector for detecting the angular position of said rotor with respect to said stator;

a needle position detector for detecting the position of a sewing needle connected to said main shaft;

a first control unit responsive to a drive command and a signal from said angular position detector for driving said reluctance motor at variable speeds; and a second control unit responsive to a stop command and signals from said angular position detector and said needle position detector for braking said reluctance motor to stop said sewing needle in a prescribed needle position.

2. A sewing machine driving system according to claim 1, wherein said drive circuit comprises an inverter receptive of a direct current converted by a converter for energizing stator windings based on a timing signal from said first and second control units.

3. A sewing machine driving system according to claim 1, wherein said first control unit is responsive to the signal from said angular position detector for determining stator poles which generate a positive torque on said rotor when the windings on those stator poles are energized, and for energizing said windings on those stator poles.

4. A sewing machine driving system according to claim 3, wherein said first control unit is responsive to the signal from said angular position detector for determining the stator poles corresponding to those rotor poles which are present in a range between a first spatial phase difference where terminal ends of the rotor poles in the direction of rotation are aligned with terminal ends of the stator poles and a second spatial phase difference where the poles are fully overlapped radially, and which are directed toward said second spatial phase difference.

5. A sewing machine driving system according to claim 1, wherein said second control unit is responsive to the signal from said angular position detector for determining stator poles which generate a negative torque on said rotor when the windings on those stator poles are energized, and for energizing said windings on those stator poles.

6. A sewing machine driving system according to claim 5, wherein said second control unit is responsive to the signal from said angular position detector for determining the stator poles corresponding to those rotor poles which are present in a range between a first spatial phase difference where the poles are fully overlapped radially and a second spatial phase difference where the poles are not fully overlapped radially, and which are directed toward said second spatial phase difference.

7. A sewing machine driving system comprising:

a reluctance motor operatively coupled to a sewing machine main shaft and having a stator and a rotor;

a drive circuit for driving said reluctance motor;

an angular position detector for detecting the angular position of said rotor with respect to said stator;

a speed detector for detecting the actual speed of rotation of said reluctance motor;

a needle position detector for detecting the position of a sewing needle connected to said main shaft;

a control pedal;

a speed command signal generator for commanding a speed of rotation of said reluctance motor based on the extent to which said control pedal is operated;

a first control unit for comparing the speed of rotation detected by said speed command signal generator based on operation of said control pedal and the acutal speed of rotation of said reluctance motor detected by said speed detector, and for driving said reluctance motor at variable speeds in response to a signal from said angular position detector in order to achieve the speed of rotation selected by said control pedal; and a second control unit responsive to the stoppage of operation of said control pedal and signals from said angular position detector and said needle position detector for braking said reluctance motor to stop said sewing needle in a predetermined needle position.

8. A sewing machine driving system according to claim 7, wherein said speed detector comprises a disc fixed to an output shaft of said reluctance motor and a detector for detecting magnets mounted on said disc.

9. A sewing machine driving system according to claim 7, wherein said first control unit is responsive to the signal from said angular position detector for determining the stator poles corresponding to those rotor poles which are present in a range between a first spatial phase difference where terminal ends of the rotor poles in the direction of rotation are aligned with terminal ends of the stator poles and a second spatial phase difference where the poles are fully overlapped radially, and which are directed toward said second spatial phase difference, and for determining a timing for energizing the windings, in order to generate a positive torque on said rotor.

10. A sewing machine driving system according to claim 7, wherein said first control unit compares the actual speed detected by said speed detector and the speed generated by said speed command signal generator, and is responsive to the signal from said angular position detector for determining the stator poles which produce a positive torque on said rotor and a voltage to be applied, thereby to control the rotation of said reluctance motor.

11. A sewing machine driving system according to claim 7, wherein said second control unit is responsive to the signal from said angular position detector for determining the stator poles corresponding to those rotor poles which are present in a range between a first spatial phase difference where the poles are fully overlapped radially and a second spatial phase difference where the poles are not fully overlapped radially, and which are directed toward said second spatial phase difference, and for determining a timing for energizing the windings, in order to generate a negative torque on said rotor.

12. A sewing machine driving system according to claim 7, wherein said second control unit is responsive to the signal from said speed detector for determining the actual speed of rotation of said reluctance motor, and for controlling said reluctance motor until the actual speed of rotation of said reluctance motor reaches a predetermined low speed range, and for keeping the speed of rotation of said reluctance motor in said low speed range for a predetermined period of time.

13. A sewing machine driving system comprising:

a reluctance motor operatively coupled to a sewing machine main shaft and having a stator and a rotor;

a drive circuit for driving said reluctance motor;

an angular position detector for detecting the angular position of said rotor with respect to said stator;

a needle position detector for detecting the position of a sewing needle connected to said main shaft;

a control pedal;

a first control unit responsive to a forward depression of said control pedal and a signal from said angular position detector for driving said reluctance motor at variable speeds;

a second control unit responsive to a neutral position of said control pedal and signals from said angular position detector and said needle position detector for braking said reluctance motor to stop said sewing needle in a predetermined needle stop position; and a third control unit responsive to a rearward depression of said control pedal and signals from said angular position detector and said needle position detector for controlling said reluctance motor to stop said sewing needle in a predetermined needle position and for energizing a solenoid to operate a thread cutting device.

14. A sewing machine driving system according to claim 13, wherein said stator of the reluctance motor comprises a laminated iron core with concentrated windings thereon and said rotor comprises a laminated iron core fixed to an output shaft of the motor.

15. A sewing machine driving system according to claim 13, wherein said stator of said reluctance motor has eight stator poles and said rotor has six rotor poles.

16. A sewing machine driving system according to claim 13, wherein said drive circuit comprises an inverter receptive of a direct current converted by a converter for energizing stator windings based on a timing signal from said first, second and third control units.

17. A sewing machine driving system according to claim 13, wherein said angular position detector comprises a disc fixed to an output shaft of said reluctance motor and a photointerrupter for detecting slits defined in said disc.

18. A sewing machine driving system according to claim 13, wherein said needle position detector is supported on a bracket disposed near an end of said main shaft for detecting the angular position of said main shaft.

* * * * *